US012000653B2

(12) United States Patent
Ducote, Jr. et al.

(10) Patent No.: US 12,000,653 B2
(45) Date of Patent: Jun. 4, 2024

(54) SYSTEM AND METHOD FOR REMOVING FREEZING COMPONENTS FROM A FEED GAS

(71) Applicant: Chart Energy & Chemicals, Inc., Ball Ground, GA (US)

(72) Inventors: Douglas A. Ducote, Jr., The Woodlands, TX (US); Timothy P. Gushanas, Pearland, TX (US); Mark R. Glanville, The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 13 days.

(21) Appl. No.: 16/843,508

(22) Filed: Apr. 8, 2020

(65) Prior Publication Data

US 2020/0232703 A1 Jul. 23, 2020

Related U.S. Application Data

(63) Continuation of application No. 16/297,971, filed on Mar. 11, 2019, now Pat. No. 10,619,918, which is a (Continued)

(51) Int. Cl.

| | |
|---|---|
| ***F25J 1/00*** | (2006.01) |
| ***F25J 1/02*** | (2006.01) |
| ***F25J 3/02*** | (2006.01) |

(52) U.S. Cl.

CPC ..... *F25J 1/0022* (2013.01); *F25J 1/0035* (2013.01); *F25J 1/004* (2013.01); *F25J 1/0042* (2013.01);

(Continued)

(58) Field of Classification Search

CPC ..... F25J 3/0209; F25J 3/0233; F25J 3/0238; F25J 3/0242; F25J 3/0247; F25J 1/0022;

(Continued)

(56) References Cited

U.S. PATENT DOCUMENTS

| | | | |
|---|---|---|---|
| 3,098,732 | A | 7/1963 | Dennis |
| 3,503,220 | A | 3/1970 | Desai |

(Continued)

FOREIGN PATENT DOCUMENTS

| | | | |
|---|---|---|---|
| CN | 103409188 | A | 11/2013 |
| EP | 0102087 | A2 | 3/1984 |

(Continued)

OTHER PUBLICATIONS

Office Action from the Chinese PTO for counterpart application CN201680032085 dated Mar. 27, 2020 with English Translation (13 pages).

(Continued)

*Primary Examiner* — Frantz F Jules
*Assistant Examiner* — Webeshet Mengesha
(74) *Attorney, Agent, or Firm* — Cook Alex Ltd.

(57) ABSTRACT

A system for removing freezing components from a feed gas includes a heat exchanger, a scrub column and a return vapor expansion device. The heat exchanger includes a reflux cooling passage and a return vapor passage. Vapor from the scrub column is directed through the return vapor expansion device, where the temperature and pressure are lowered. The resulting cooled fluid then travels to the return vapor passage of the heat exchanger and is used to cool a vapor stream in the reflux cooling passage to create a reflux fluid stream that is directed to the scrub column.

6 Claims, 10 Drawing Sheets

Related U.S. Application Data continuation-in-part of application No. 15/702,271, filed on Sep. 12, 2017, now Pat. No. 10,267,559, which is a continuation of application No. 15/095,631, filed on Apr. 11, 2016, now Pat. No. 10,060,671.

(60) Provisional application No. 62/215,511, filed on Sep. 8, 2015, provisional application No. 62/145,929, filed on Apr. 10, 2015.

(52) U.S. Cl.
CPC ..... *F25J 1/0055* (2013.01); *F25J 1/0057* (2013.01); *F25J 1/0219* (2013.01); *F25J 1/023* (2013.01); *F25J 1/0238* (2013.01); *F25J 1/0257* (2013.01); *F25J 1/0262* (2013.01); *F25J 1/0267* (2013.01); *F25J 1/0279* (2013.01); *F25J 1/0283* (2013.01); *F25J 1/0294* (2013.01); *F25J 3/0209* (2013.01); *F25J 3/0233* (2013.01); *F25J 3/0238* (2013.01); *F25J 3/0242* (2013.01); *F25J 2200/02* (2013.01); *F25J 2200/04* (2013.01); *F25J 2200/70* (2013.01); *F25J 2200/72* (2013.01); *F25J 2200/74* (2013.01); *F25J 2200/76* (2013.01); *F25J 2200/78* (2013.01); *F25J 2210/04* (2013.01); *F25J 2220/64* (2013.01); *F25J 2230/08* (2013.01); *F25J 2230/20* (2013.01); *F25J 2230/22* (2013.01); *F25J 2230/24* (2013.01); *F25J 2230/30* (2013.01); *F25J 2230/60* (2013.01); *F25J 2240/02* (2013.01); *F25J 2240/30* (2013.01); *F25J 2245/02* (2013.01); *F25J 2245/90* (2013.01); *F25J 2260/20* (2013.01); *F25J 2260/60* (2013.01); *F25J 2270/18* (2013.01); *F25J 2270/66* (2013.01); *F25J 2280/02* (2013.01)

(58) Field of Classification Search
CPC ..... F25J 1/0209; F25J 1/0233; F25J 1/0238; F25J 1/0242; F25J 1/0247; F25J 1/0057; F25J 1/0219; F25J 2220/64; F25J 2200/02; F25J 2200/72; F25J 2200/74; F25J 2200/76; F25J 2200/78
See application file for complete search history.

(56) References Cited

U.S. PATENT DOCUMENTS

| | | | | |
|---|---|---|---|---|
| 3,729,945 | A | 5/1973 | Linnett | |
| 4,004,430 | A | 1/1977 | Solomon et al. | |
| 4,272,270 | A | 6/1981 | Higgins | |
| 4,445,916 | A | 5/1984 | Newton | |
| 4,445,917 | A | 5/1984 | Chiu | |
| 4,970,867 | A | 11/1990 | Herron et al. | |
| 5,036,671 | A | 8/1991 | Nelson et al. | |
| 5,325,673 | A | 7/1994 | Durr et al. | |
| 5,615,561 | A | 4/1997 | Houshmand et al. | |
| 5,718,126 | A | 2/1998 | Capron et al. | |
| 5,737,940 | A | 4/1998 | Yao et al. | |
| 5,755,114 | A * | 5/1998 | Foglietta | F25J 1/0208 62/621 |
| 5,893,274 | A | 4/1999 | Nagelvoort et al. | |
| 5,956,971 | A | 9/1999 | Cole et al. | |
| 6,053,007 | A | 4/2000 | Victory et al. | |
| 6,085,545 | A | 7/2000 | Johnston | |
| 6,214,258 | B1 | 4/2001 | Woodward et al. | |
| 6,272,882 | B1 | 8/2001 | Hodges et al. | |
| 6,401,486 | B1 | 6/2002 | Lee et al. | |
| 6,751,985 | B2 | 6/2004 | Kimble et al. | |
| 7,237,406 | B2 | 7/2007 | Voss et al. | |
| 7,310,971 | B2 | 12/2007 | Eaton et al. | |
| 7,325,415 | B2 | 2/2008 | Amin et al. | |
| 7,866,184 | B2 | 1/2011 | Eaton | |
| 8,418,499 | B2 | 4/2013 | Jeong et al. | |
| 8,424,340 | B2 | 4/2013 | Eaton et al. | |
| 8,528,360 | B2 | 9/2013 | Betting et al. | |
| 8,667,812 | B2 | 3/2014 | Cuellar et al. | |
| 8,794,030 | B2 | 8/2014 | Martinez et al. | |
| 8,850,849 | B2 | 10/2014 | Martinez et al. | |
| 9,316,434 | B2 | 4/2016 | Paradowski et al. | |
| 2002/0070560 | A1 | 6/2002 | Hylton | |
| 2004/0103687 | A1 | 6/2004 | Clare et al. | |
| 2005/0284176 | A1 * | 12/2005 | Eaton | F25J 3/0238 62/613 |
| 2008/0016910 | A1 | 1/2008 | Brostow et al. | |
| 2008/0115532 | A1 | 5/2008 | Jager | |
| 2008/0256976 | A1 | 10/2008 | Eaton | |
| 2010/0011810 | A1 | 1/2010 | Mak et al. | |
| 2010/0242536 | A1 | 9/2010 | Paradowski et al. | |
| 2010/0281915 | A1 | 11/2010 | Roberts et al. | |
| 2010/0287982 | A1 | 11/2010 | Martinez et al. | |
| 2011/0226008 | A1 | 9/2011 | Gushanas et al. | |
| 2011/0226009 | A1 * | 9/2011 | Paradowski | F25J 1/0208 62/613 |
| 2011/0259044 | A1 | 10/2011 | Baudat et al. | |
| 2012/0047943 | A1 | 3/2012 | Barclay et al. | |
| 2013/0074542 | A1 | 3/2013 | Mehrpooya et al. | |
| 2013/0174603 | A1 | 7/2013 | Roberts et al. | |
| 2013/0213087 | A1 | 8/2013 | Currence | |
| 2013/0219955 | A1 | 8/2013 | Yoo et al. | |
| 2013/0327085 | A1 | 12/2013 | Eaton | |
| 2013/0333415 | A1 | 12/2013 | Kimmel | |
| 2014/0033762 | A1 | 2/2014 | Chen et al. | |
| 2014/0033763 | A1 | 2/2014 | Chen et al. | |
| 2014/0096563 | A2 * | 4/2014 | Martinez | F25J 3/0209 62/620 |
| 2014/0260417 | A1 | 9/2014 | Herzog et al. | |
| 2014/0283548 | A1 | 9/2014 | He et al. | |
| 2015/0013378 | A1 | 1/2015 | He et al. | |
| 2015/0033793 | A1 | 2/2015 | Griffiths | |
| 2015/0184930 | A1 | 7/2015 | Bonnissel et al. | |
| 2015/0246859 | A1 * | 9/2015 | Mak | F25J 3/0209 585/800 |
| 2015/0377551 | A1 * | 12/2015 | Jiang | F25J 3/0209 62/620 |
| 2016/0313056 | A1 | 10/2016 | Kikkawa et al. | |

FOREIGN PATENT DOCUMENTS

| | | | |
|---|---|---|---|
| JP | H08159652 | A | 6/1996 |
| WO | 2006123240 | A1 | 11/2006 |
| WO | 2010058277 | A2 | 5/2010 |
| WO | WO2011135335 | A2 | 11/2011 |
| WO | WO2014021900 | A1 | 2/2014 |
| WO | WO2014150024 | A1 | 9/2014 |
| WO | WO2015017357 | A1 | 2/2015 |
| WO | WO2015138846 | A1 | 9/2015 |

OTHER PUBLICATIONS

Communication pursuant to Article 94(3) EPC for European Application No. 16777478.5 dated Sep. 3, 2021.

International Search Report and Written Opinion, counterpart International Appl. No. PCT/US2016/026924, dated Aug. 19, 2016.

Office Action from the Patent Office of Brazil for Application No. BR112017021399-0 dated Jul. 1, 2020 (5 pages).

Office Action from the Taiwan Patent Office for Patent Application No. 1051411143, dated Oct. 28, 2019 with English Translation, 47 pages total.

Canadian Examiner's Report dated Jul. 29, 2022 for Canadian Application No. 2,982,210.

Notification of Reasons for Rejection for Japanese Patent Application No. 2021-212543 dated Oct. 19, 2022.

* cited by examiner

SYSTEM AND METHOD FOR REMOVING FREEZING COMPONENTS FROM A FEED GAS

CLAIM OF PRIORITY

This application is a continuation of prior U.S. application Ser. No. 16/297,971, filed Mar. 11, 2019, which is a continuation-in-part of prior U.S. application Ser. No. 15/702,271, filed Sep. 12, 2017, which is a continuation application of prior U.S. application Ser. No. 15/095,631, filed Apr. 11, 2016, now U.S. Pat. No. 10,060,671, which claims the benefit of U.S. Provisional Application No. 62/145,929, filed Apr. 10, 2015, and U.S. Provisional Application No. 62/215,511, filed Sep. 8, 2015, the contents of each of which are hereby incorporated by reference.

FIELD OF THE DISCLOSURE

The present invention relates generally to systems and methods for processing gases and, more particularly, to a system and method for removing freezing components from a feed gas.

SUMMARY OF THE DISCLOSURE

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for removing freezing components from a feed gas includes a scrub column having a feed gas inlet, a reflux liquid inlet and a vapor outlet, where the feed gas inlet is configured to receive at least a portion of the feed gas. A heat exchanger includes a reflux cooling passage and a return vapor passage, with the return vapor passage and the reflux cooling passage of the heat exchanger configured so that fluid flowing through the reflux cooling passage of the heat exchanger is cooled by return fluid flowing through the return vapor passage of the heat exchanger. The reflux cooling passage of the heat exchanger is configured to receive and cool a reflux vapor stream that is at least a portion of the feed gas, prior to any portion of the reflux vapor stream flowing through the return vapor passage of the heat exchanger, so that a reflux fluid stream is formed and to direct at least a portion of the reflux fluid stream to the reflux liquid inlet of the scrub column. A return vapor expansion device has an inlet in fluid communication with the vapor outlet of the scrub column. The return vapor expansion device also has an outlet in communication with an inlet of the return vapor passage of the heat exchanger and the return vapor expansion device is configured so that a pressure and a temperature of at least a portion of the return vapor stream from the vapor outlet of the scrub column are lowered and directed into the return vapor passage of the heat exchanger. A processed feed gas line is in communication with an outlet of the vapor return passage of the heat exchanger.

In another aspect, a system for removing freezing components from a feed gas includes a scrub device having a scrub column having a feed gas inlet, a reflux liquid inlet and a vapor outlet, where the feed gas inlet is configured to receive at least a portion of the feed gas. The scrub device also includes a reflux separation device, where the reflux separation device includes a mixed phase inlet, a reflux liquid outlet that is in fluid communication with the reflux liquid inlet of the scrub column, and a reflux separation device vapor outlet that is in fluid communication with the vapor outlet of the scrub column. A heat exchanger includes a reflux cooling passage and a return vapor passage, with the return vapor passage and the reflux cooling passage of the heat exchanger configured so that fluid flowing through the reflux cooling passage of the heat exchanger is cooled by return fluid flowing through the return vapor passage of the heat exchanger. The reflux cooling passage of the heat exchanger is configured to receive and cool a reflux vapor stream that is at least a portion of the feed gas, prior to any portion of the reflux vapor stream flowing through the return vapor passage of the heat exchanger, so that a mixed phase reflux stream is formed and to direct at least a portion of the mixed phase reflux stream to the mixed phase inlet of the reflux separation device of the scrub device. A return vapor expansion device has an inlet in fluid communication with the vapor outlet of the scrub column. The return vapor expansion device also has an outlet in communication with an inlet of the return vapor passage of the heat exchanger. The return vapor expansion device is configured so that a pressure and a temperature of at least a portion of the return vapor stream from the vapor outlet of the scrub column are lowered and directed into the return vapor passage of the heat exchanger. A processed feed gas line is in communication with an outlet of the vapor return passage of the heat exchanger.

In yet another aspect, a method for removing freezing components from a feed gas includes the steps of: providing a heat exchanger, a scrub column and a return vapor expansion device; directing at least a portion of the feed gas to a feed gas inlet of the scrub column; directing a reflux vapor stream that is at least a portion of the feed gas to a reflux cooling passage of the heat exchanger; cooling the reflux vapor stream, prior to any portion of the reflux vapor stream flowing through a return vapor passage of the heat exchanger, so that a reflux fluid stream is formed; directing the reflux fluid stream to a reflux liquid inlet of the scrub device; vaporizing the reflux fluid stream in the scrub device so that the freezing components are condensed and removed from the feed gas in the scrub device; directing a return vapor stream from the scrub column to the return vapor expansion device; lowering a temperature and a pressure of the return vapor stream in the expansion device to form a return fluid stream; directing the return fluid stream to a return vapor passage of the heat exchanger and warming the return fluid stream in the return vapor passage of the heat exchanger.

DETAILED DESCRIPTION OF EMBODIMENTS

Figure 1:
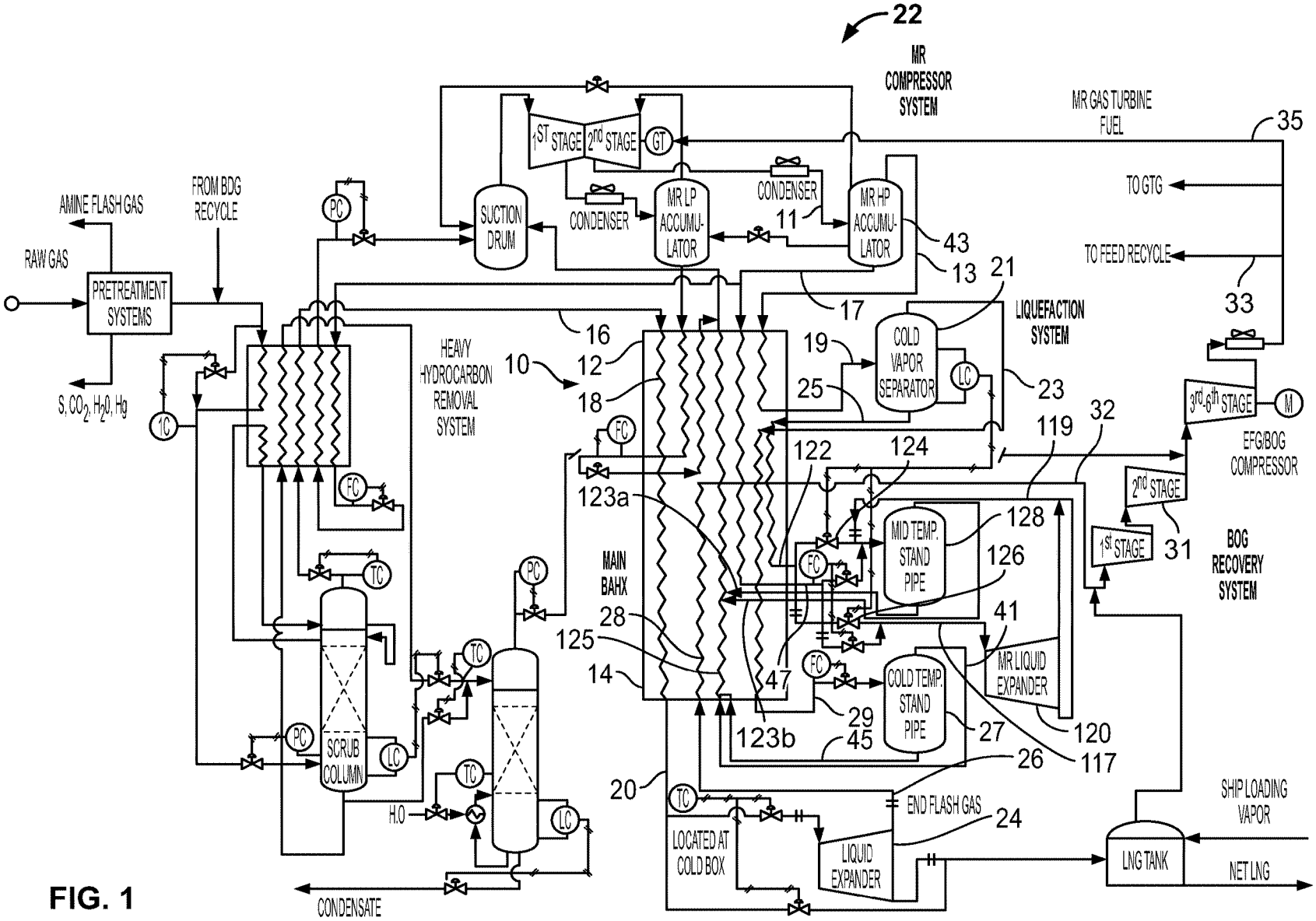
FIG. 1 is a process flow diagram and schematic illustrating a mixed refrigerant liquefaction system and method with a vapor/liquid separator in the liquefied gas stream at the cold end of the main heat exchanger where the cold end flash gas from the separator is directed to an additional refrigeration pass through the main heat exchanger.

Embodiments of a mixed refrigerant liquefaction system and method are illustrated in FIGS. 1-8. It should be noted that while the embodiments are illustrated and described below in terms of liquefying natural gas to produce liquid natural gas, the invention may be used to liquefy other types of gases.

The basic liquefaction process and mixed refrigerant compressor system are described in commonly owned U.S. Pat. No. 9,411,877, to Gushanas et al., the contents of which are hereby incorporated by reference. Generally, with reference to FIG. 1, the system includes a multi-stream heat exchanger, indicated in general at 10, having a warm end 12 and a cold end 14. The heat exchanger receives a high pressure natural gas feed stream 16 that is liquefied in cooling or liquefying passage 18 via removal of heat via heat exchange with refrigeration streams in the heat exchanger. As a result, a stream 20 of liquid natural gas (LNG) product is produced. The multi-stream design of the heat exchanger allows for convenient and energy-efficient integration of several streams into a single exchanger. Suitable heat exchangers may be purchased from Chart Energy & Chemicals, Inc. of The Woodlands, Texas. The plate and fin multi-stream heat exchanger available from Chart Energy & Chemicals, Inc. offers the further advantage of being physically compact.

The system of FIG. 1, including heat exchanger 10, may be configured to perform other gas processing options known in the prior art. These processing options may require the gas stream to exit and reenter the heat exchanger one or more times and may include, for example, natural gas liquids recovery or nitrogen rejection.

The removal of heat is accomplished in the heat exchanger using a mixed refrigerant, that is processed and reconditioned using a mixed refrigerant compressor system indicated in general at 22. The mixed refrigerant compressor system includes a high pressure accumulator 43 that receives and separates a mixed refrigerant (MR) mixed-phase stream 11 after a last compression and cooling cycle. While an accumulator drum 43 is illustrated, alternative separation devices may be used, including, but not limited to, another type of vessel, a cyclonic separator, a distillation unit, a coalescing separator or mesh or vane type mist eliminator. High pressure vapor refrigerant stream 13 exits the vapor outlet of the accumulator 43 and travels to the warm side of the heat exchanger 10.

High pressure liquid refrigerant stream 17 exits the liquid outlet of accumulator 43 and also travels to the warm end of the heat exchanger. After cooling in the heat exchanger 10, it travels as mixed phase stream 47 to mid-temp stand pipe 128.

After the high pressure vapor stream 13 from the accumulator 43 is cooled in the heat exchanger 10, mixed phase stream 19 flows to cold vapor separator 21. A resulting vapor refrigerant stream 23 exits the vapor outlet of the separator 21 and, after cooling in the heat exchanger 10, travels to cold temperature stand pipe 27 as mixed-phase stream 29. Vapor and liquid streams 41 and 45 exit the cold temperature stand pipe 27 and feed into the primary refrigeration passage 125 on the cold side of the heat exchanger 10.

The liquid stream 25 exiting the cold vapor separator 21 is cooled in heat exchanger 10 and exits the heat exchanger as mixed phase stream 122, which is handled in the manner described below.

The systems of FIGS. 2-8 feature components similar to those described above.

The system shown in FIG. 1 utilizes an expander separator 24, which may be liquid expander with integrated vapor/liquid separator or, alternatively, a liquid expander in series with any vapor/liquid separation device, to extract energy from the high pressure LNG stream 20, as pressure is reduced. This results in reduced LNG temperature and resulting end flash gas (EFG); thereby, providing improved LNG production for the same MR power and improved energy consumption per tonne of LNG produced. The cold end flash gas, resulting from the liquid expansion, exits the vapor/liquid separator 24 as stream 26 and is sent to the main liquefaction heat exchanger 10 at the cold end and is integrated with the heat exchanger by incorporating an additional refrigeration passage 28, such that it contributes to the overall refrigeration requirements for liquefaction, thereby further improving LNG production for the same MR power without adding significant capital cost to the main heat exchanger 10.

In the system of FIG. 1, the EFG refrigeration is either totally recovered in the heat exchanger 10 or may be partially recovered as best fits the equipment and process design. The warmed end flash gas exits the heat exchanger as stream 32 and, after optional compression via compressor(s) 31, can be recycled to the plant feed gas 33, used as gas turbine/plant fuel 35 or disposed in any other acceptable manner. The LNG liquid expander can be used either with or without the mid-temperature liquid expander described below with reference to FIG. 1A.

Figure 2:
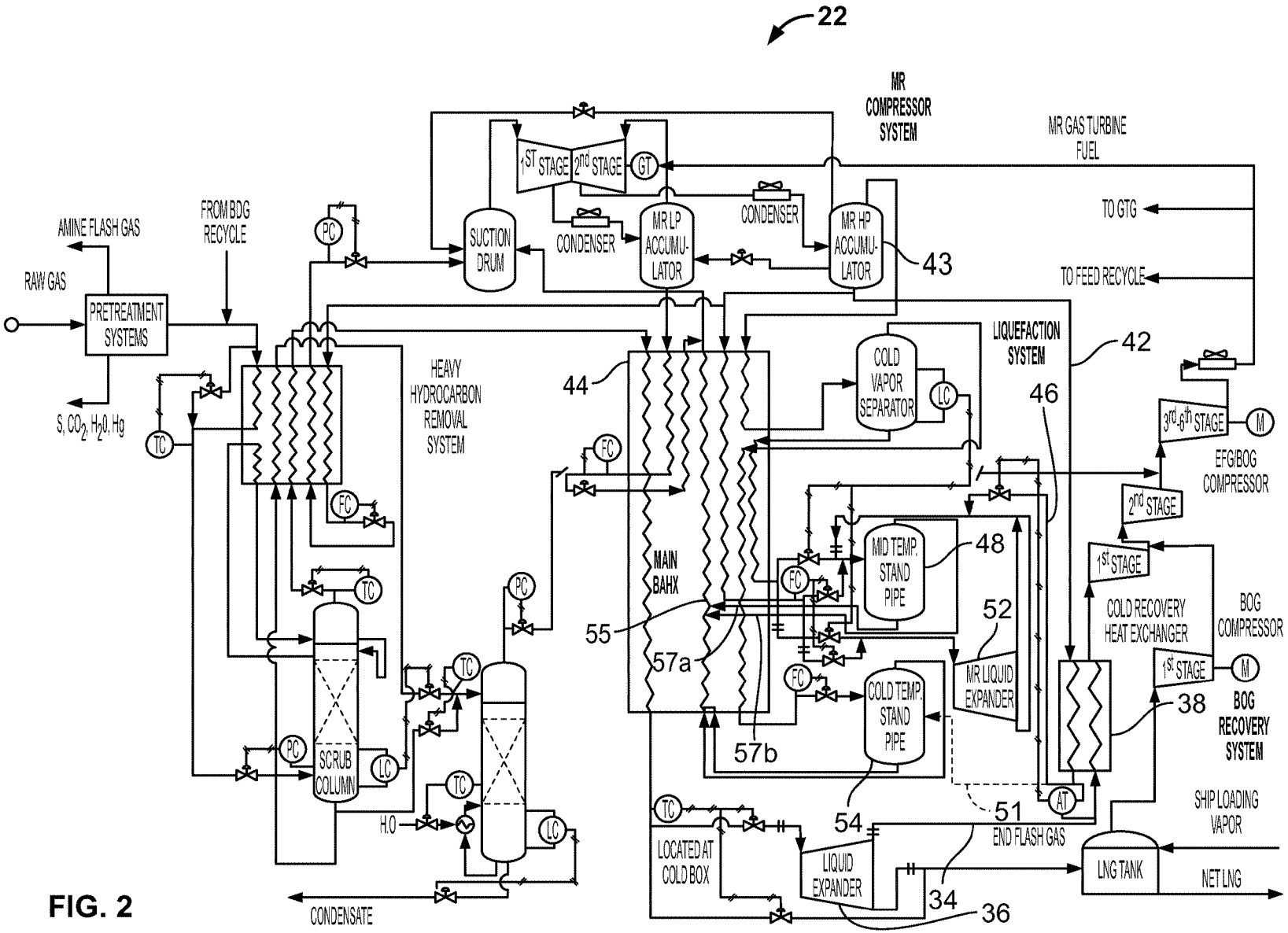
FIG. 2 is a process flow diagram and schematic illustrating a mixed refrigerant liquefaction system and method with a vapor/liquid separator in the liquefied gas stream at the cold end of the main heat exchanger where the cold end flash gas from the separator is directed to a cold recovery heat exchanger for cooling the mixed refrigerant.

The system of FIG. 2 features an option to the EFG cold recovery configuration shown in FIG. 1. In this option, the EFG cold refrigeration stream 34 from the vapor/liquid separator 36 is directed to a cold recovery heat exchanger 38 where it is heat exchanged by with a warm high pressure mixed refrigerant (MR) stream, or streams 42 from a high pressure accumulator 43 of the MR compressor system 22. The high pressure MR stream 42 is cooled using the EFG from stream 34, then returned to a refrigeration passage 55 of the liquefying heat exchanger 44 via line 46 and the mid-standpipe (middle temperature standpipe) 48 (as shown by line 49 in FIG. 3) or, alternatively, a mid-temperature liquid expander 52 (as shown by line 46 in FIG. 2) or a cold standpipe 54 (as shown in phantom by line 51 in FIG. 2).

Once the cooled high pressure MR stream from the cold recovery heat exchanger 38 is received by the mid-standpipe 48 or the mid-temperature liquid expander separator 52, it is delivered to the refrigeration passage 55 of the liquefying heat exchanger 44 by lines 57*a* and 57*b* (of FIG. 2).

Figure 2A:
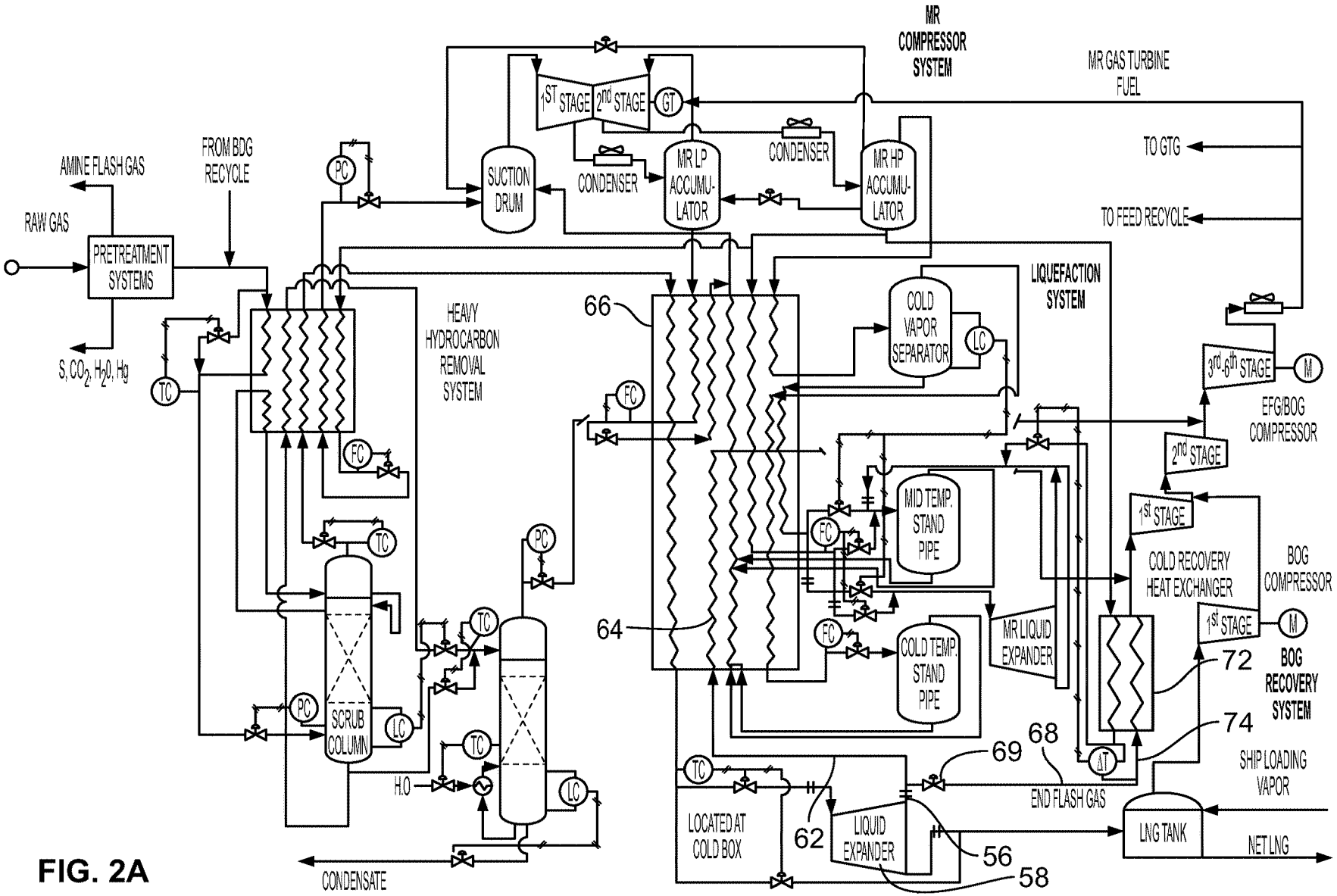
FIG. 2A is a process flow diagram and schematic illustrating a mixed refrigerant liquefaction system and method with a vapor/liquid separator in the liquefied gas stream at the cold end of the main heat exchanger where the cold end flash gas from the separator is directed to an additional refrigeration pass through the main heat exchanger and a cold recovery heat exchanger for cooling the mixed refrigerant.

The EFG cold recovery options of FIGS. 1 and 2 can be combined as illustrated in FIG. 2A. More specifically, the EFG stream 56 exiting the vapor/liquid separator 58 is split to form stream 62, which leads to the refrigeration passage 64 of the main heat exchanger 66, and stream 68, which leads to the cold recovery heat exchanger 72 to refrigerate the MR stream(s) 74 flowing through the cold recovery heat exchanger 72 as described above for the system of FIG. 2. As a result, the EFG cold is recovered in both the main heat exchanger 66 and the cold recovery heat exchanger 72, in the optimum proportions to fit the equipment and the process. The portions of EFG stream 56 flowing to stream 62 and stream 68 may be controlled by valve 69.

Figure 3:
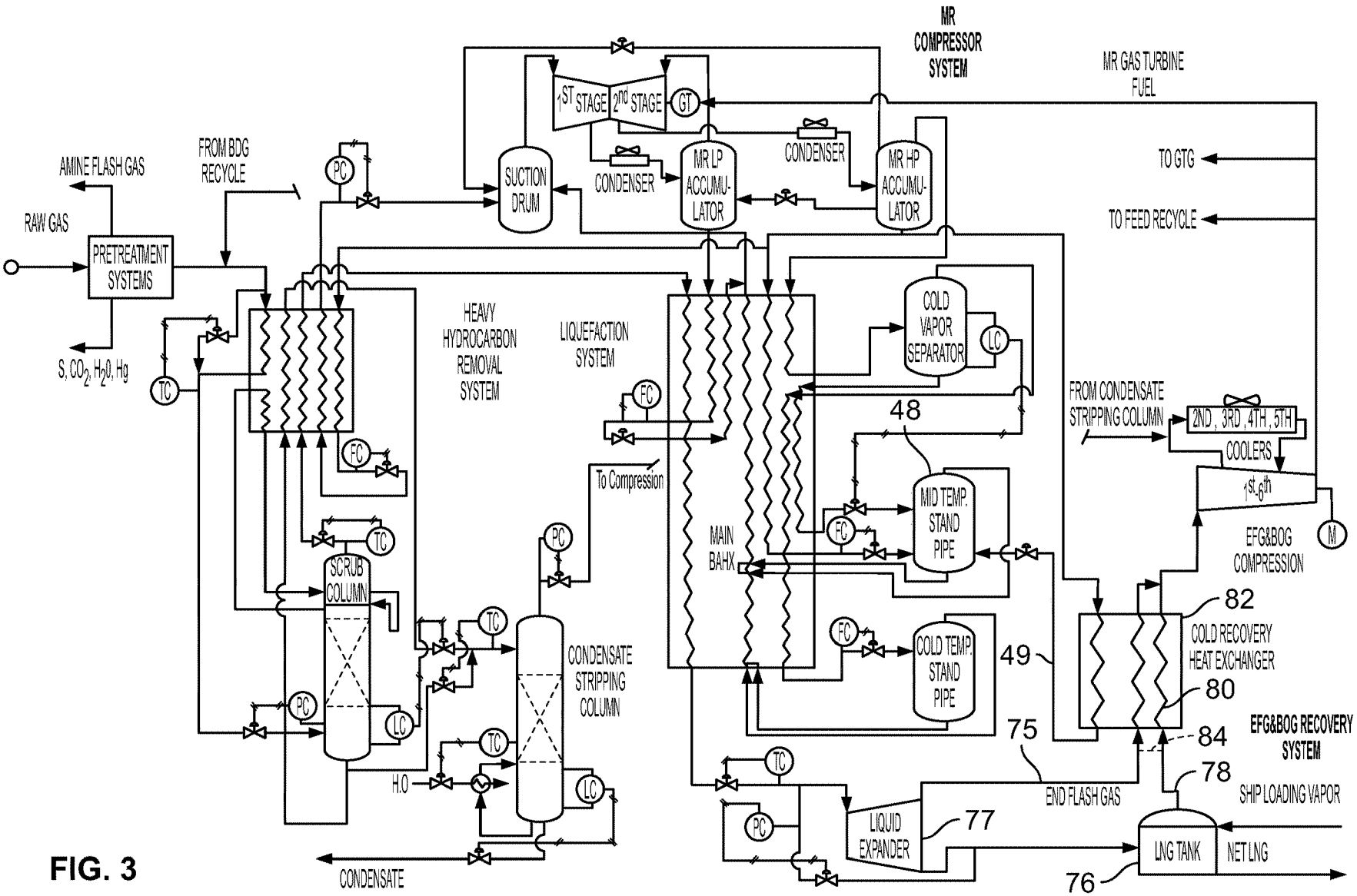
FIG. 3 is a process flow diagram and schematic illustrating a mixed refrigerant liquefaction system and method with a vapor/liquid separator in the liquefied gas stream at the cold end of the main heat exchanger where the cold end flash gas from the separator is directed to a cold recovery heat exchanger for cooling the mixed refrigerant, where the cold recovery heat exchanger also receives boil-off gas form the product storage tanks.

The system of FIG. 3 shows another option for cold recovery of both the EFG stream 75 from the vapor/liquid separator 77 and Boil-Off Gas (BOG) from the LNG product storage tank(s) 76 and other sources. In this configuration, a stream of BOG 78 exits the storage tank(s) 76 and travels to a BOG cold recovery passage 80 provided in the cold recovery heat exchanger 82. Alternatively, the cold recovery heat exchanger 82 may feature a single, shared EFG and BOG passage with the EFG and BOG streams 75 and 78 combined prior to entering the cold recovery heat exchanger 82, as indicated in phantom at 84 in FIG. 3. In either case, high pressure MR is cooled by the EFG and BOG and used as refrigeration as mentioned above.

Figure 4:
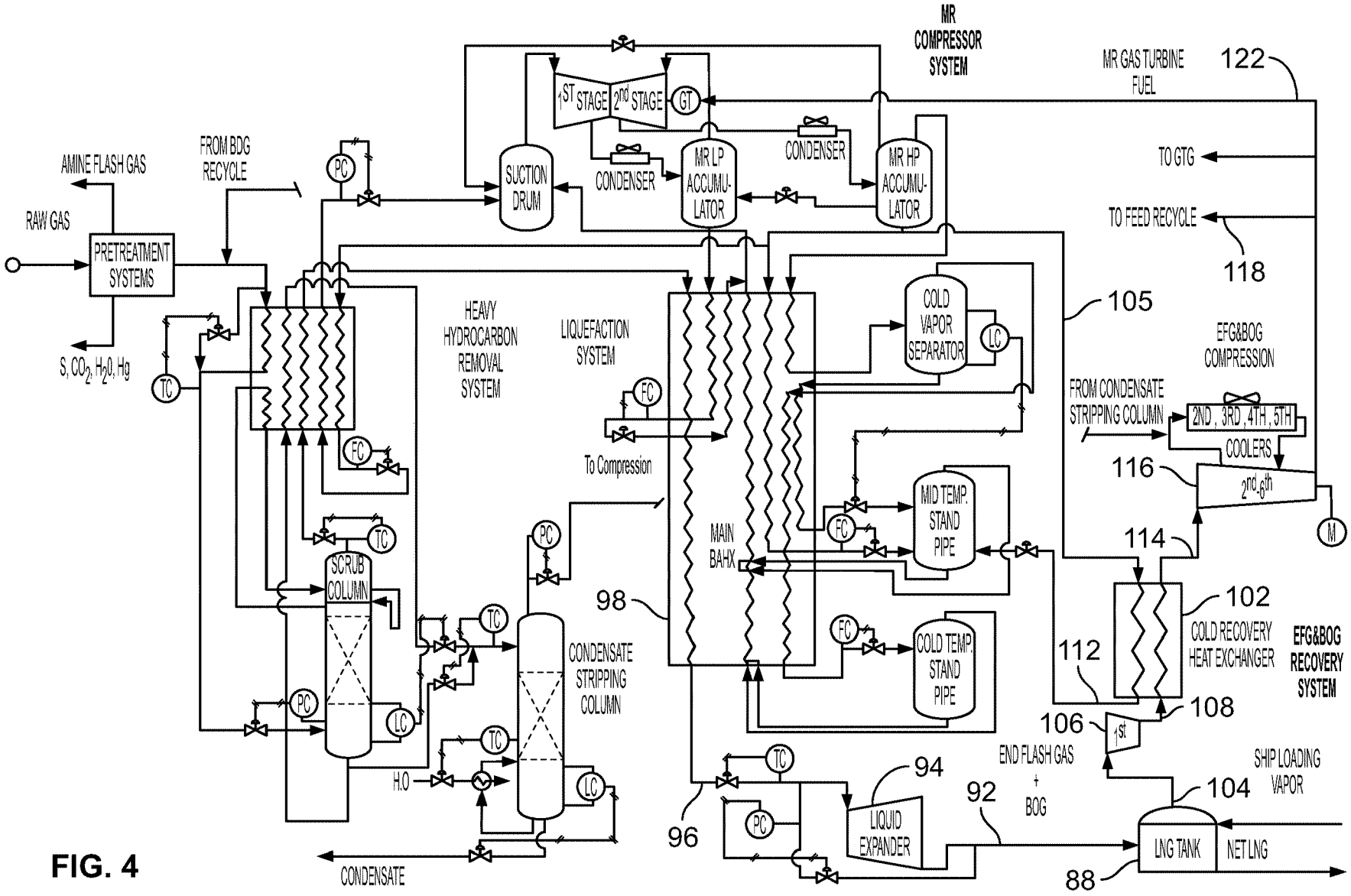
FIG. 4 is a process flow diagram and schematic illustrating a mixed refrigerant liquefaction system and method where the liquefied gas stream at the cold end of the main heat exchanger is directed to a storage tank where end flash gas is separated from the liquid product and the end flash gas and boil-off gas from the storage tank are compressed and directed to a cold recovery heat exchanger for cooling the mixed refrigerant.

In alternative embodiments, with reference to FIG. 4, the system may use the LNG product storage tank 88 as the vapor/liquid separator to obtain the EFG from the liquid product stream 92 that exits a liquid expander 94. It should be noted that a Joule-Thomson (JT) valve may be substituted for the liquid expander 94 to cool the stream. As is clear from the above descriptions, the liquid expander 94 receives the liquid product stream 96 from the main heat exchanger 98. As a result, the system of FIG. 4 provides for cold recovery of both EFG and BOG wherein the EFG is separated from the LNG in the LNG storage tank and both the EFG and BOG are directed to the cold recovery heat exchanger 102 via stream 104. As a result, a high pressure MR stream 105 flowing to the cold recovery heat exchanger 102 is cooled by the EFG and BOG.

In the system of FIG. 4, the EFG and BOG stream 104 is directed to a compressor 106 where it is compressed to a 1 stage pressure. This pressure is selected to (1) provide a pressure and temperature for the stream 108 exiting the compressor suitable to allow higher pressure drop in the cold recovery heat exchanger 102 and reduce cost; and (2) be suitable to supply a temperature to the cold recovery heat exchanger that makes the exiting cold MR steam 112 useful as a refrigerant in the main heat exchanger 98. The EFG and BOG stream 114 exiting the cold recovery heat exchanger 102 may be compressed via compressor 116 and used as feed recycle 118 or gas turbine/plant fuel 122 or disposed in any other acceptable manner.

Figure 5:
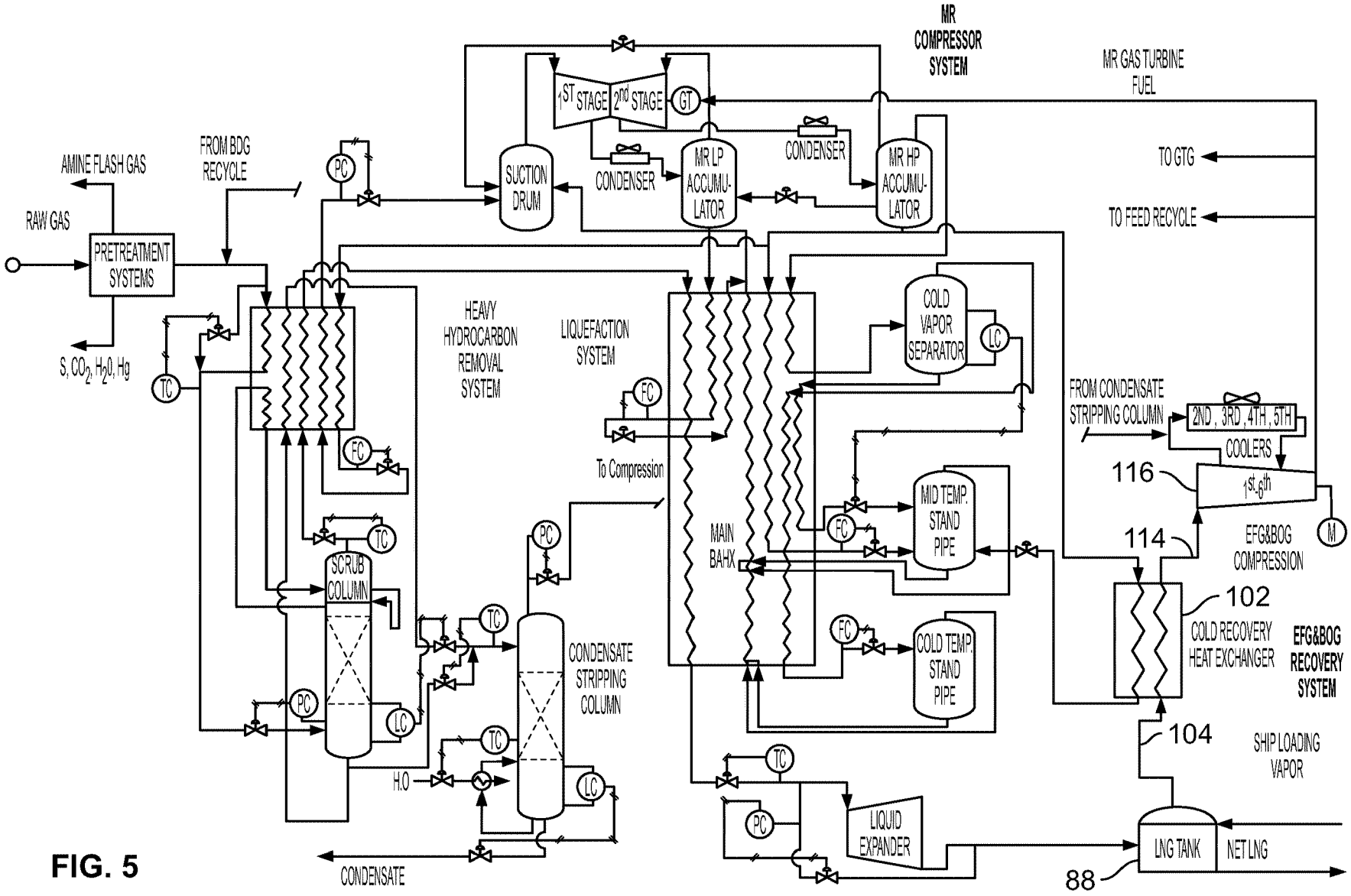
FIG. 5 is a process flow diagram and schematic illustrating a mixed refrigerant liquefaction system and method where the liquefied gas stream at the cold end of the main heat exchanger is directed to a storage tank where end flash gas is separated from the liquid product and the end flash gas and boil-off gas from the storage tank are directed to a cold recovery heat exchanger for cooling the mixed refrigerant.

As illustrated in FIG. 5, the pre-heat exchanger compressor 106 of FIG. 4 may be omitted so that the EFG and BOG stream 104 from LNG tank(s) 88 travels directly to cold recovery heat exchanger 102. As a result, only compression of the EFG and BOG stream 114 after the cold recovery heat exchanger occurs (via compressor 116). Otherwise, the system of FIG. 5 is identical to the system of FIG. 4.

Returning to FIG. 1, an optional liquid expander separator 120, which may be a liquid expander with integrated vapor/liquid separator or the two components in series, receives at least a portion of the high pressure mid-temperature MR refrigerant stream 122 through line 117. This liquid expander extracts work from the MR stream, reduces the temperature and provides additional refrigeration for LNG production after the MR fluid exiting the liquid expander travels through line 119 to the mid-temperature standpipe separator 128 and then joins the heat exchanger refrigeration stream 125 via streams 123*a* and 123*b* and improves cycle efficiency. The corresponding circuit features valves 124 and 126. With valve 126 at least partially open and valve 124 at least partially closed, the liquid expander 120 is used in series with the mid-temp stand pipe separator 128.

Figure 1A:
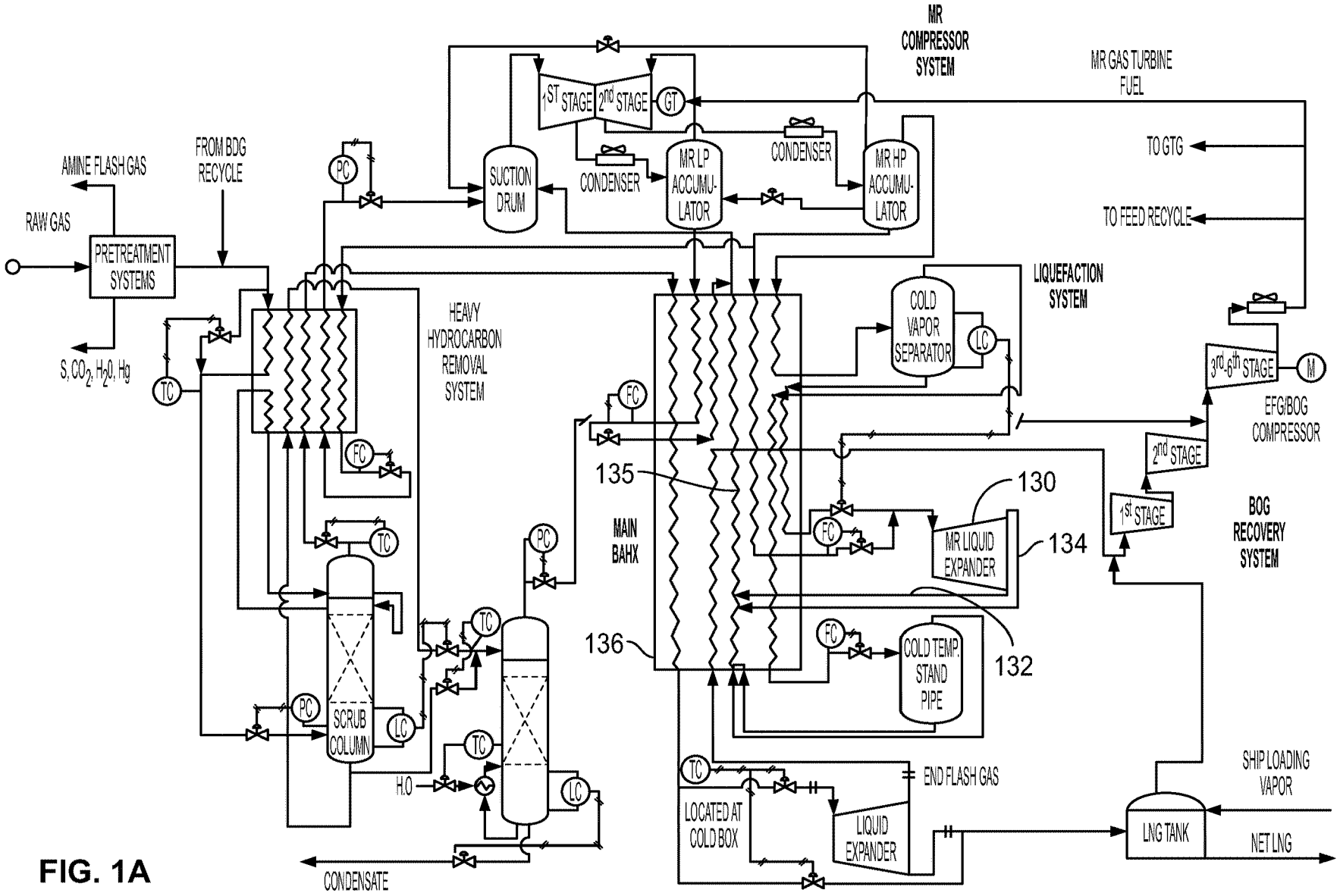
FIG. 1A is a process flow diagram and schematic illustrating a mixed refrigerant liquefaction system and method with a liquid expander with an integrated vapor/liquid separator on the high pressure mid-temperature mixed refrigerant stream.

Alternatively, with reference to FIG. 1A, a liquid expander separator 130 with integrated vapor/liquid separator/liquid pump (or the three components in series) can be used to eliminate the mid-temp stand pipe (128 of FIG. 1) and provide a separate liquid MR refrigeration stream 132 and a separate vapor MR refrigeration stream 134, which join the refrigeration stream 135 of the heat exchanger 136, to facilitate proper vapor/liquid distribution to the main heat exchanger 136 without the use of a standpipe separator. The liquid expander with integrated vapor/liquid separator/liquid pump 130 is used to increase pressure to the liquid stream, as required for the use of liquid via spray devices in the heat exchanger, and enhance distribution of the liquid within the heat exchanger. This reduces sensitivity to ship motion without increasing liquid volume (height) in the standpipe, as the standpipe is eliminated with this configuration.

The mid-temperature liquid expanders of FIG. 1 (120) and FIG. 1A (130) can be used either with or without the LNG liquid expander of FIG. 1 (24), FIG. 2 (36), FIG. 2A (58), FIG. 3 (77) and FIG. 4 (94) described above.

Figure 6:
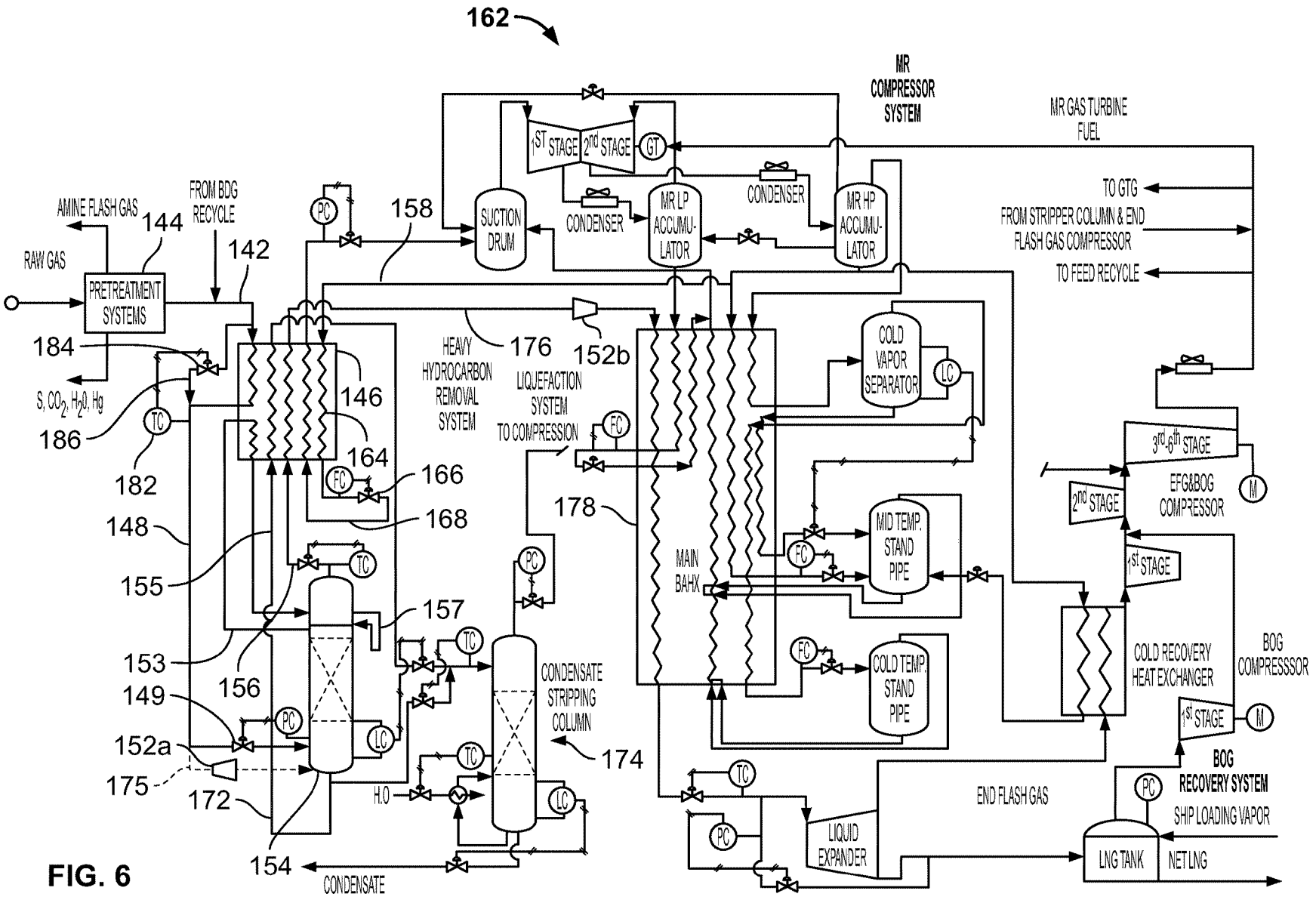
FIG. 6 is a process flow diagram and schematic illustrating a mixed refrigerant liquefaction system and method where the feed gas is first cooled with a heavy hydrocarbon removal heat exchanger and freezing components are removed from the feed gas.

A system and method for removing freezing components from the feed gas stream before liquefaction in the main heat exchanger will now be described with reference to FIG. 6. While this system is shown in the remaining figures, it is optional to the systems disclosed therein. As shown in FIG. 6, the feed gas stream 142, after any pretreatment systems 144, is cooled in a heavy hydrocarbon removal heat exchanger 146. The exit stream 148 is then reduced in pressure via a JT valve 149 or alternatively, as illustrated by line 175 in phantom, gas expander/compressor set 152*a*/152*b*, and fed to a scrub column or drum 154 or other scrub device. If the expander/compressor set 152*a*/152*b* is used, the gas expander 152*a* of line 148 drives the compressor 152*b* in line 175 to compress the gas that is to be liquefied in the main heat exchanger 178. As a result, the expander/compressor set 152*a*/152*b* reduces the energy requirements of the main heat exchanger both by reducing the pressure of the gas in line 148 and increasing the pressure of the gas in line 176.

Figure 7:
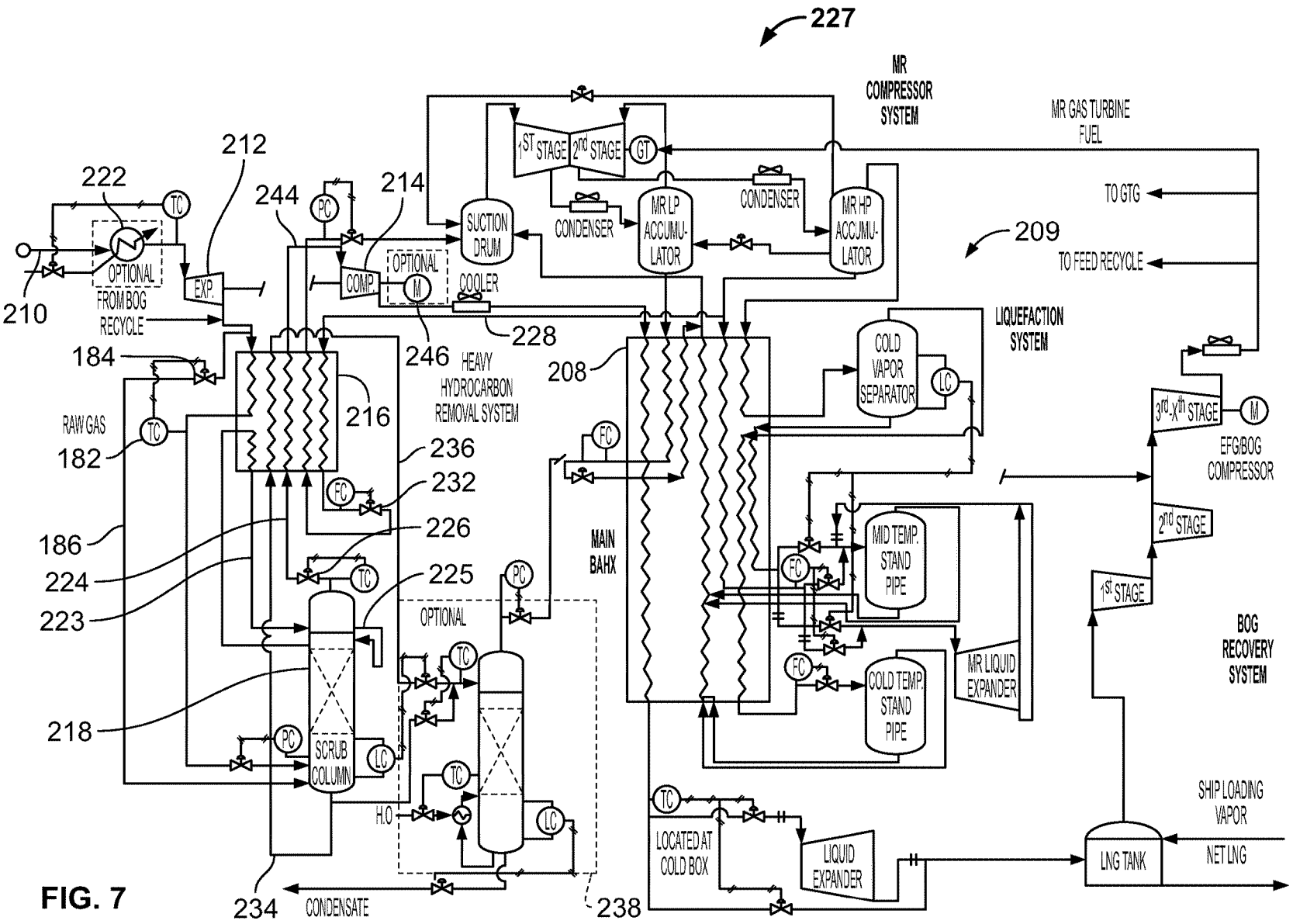
FIG. 7 is a process flow diagram and schematic illustrating an alternative mixed refrigerant liquefaction system and method where the feed gas is first cooled with a heavy hydrocarbon removal heat exchanger and freezing components are removed from the feed gas.

As illustrated at 182 in FIG. 6 (and FIG. 7), a temperature sensor 182 is in communication with line 148, and controls bypass valve 184 of cooling bypass line 186. Temperature sensor 182 detects the temperature of the cooled gas stream 148 and compares it with the setting of the associated controller (not shown) for the desired temperature or temperature range for the stream entering the scrub column 154. If the temperature of the stream 148 is below a preset level, valve 184 opens to direct more fluid through bypass line 186. If the temperature of the stream 148 is above a preset level, valve 184 closes to direct more fluid through the heat exchanger 146. As illustrated in FIG. 7, the bypass line 186 may alternatively enter the bottom of the scrub column 154 directly. The junction of bypass line 186 and line 148 illustrated in FIG. 6 is at a higher pressure than the bottom of the scrub column 154. As a result, the embodiment of FIG. 7 provides a lower outlet pressure for the bypass line 186 which provides for more accurate temperature control and permits a smaller (and more economical) bypass valve 184 to be used.

The refrigeration required to reflux the column 154 via reflux stream 155 is provided by a combination of the return vapor 156 from the column, which is warmed in the heat exchanger 146, and a mixed refrigerant (MR) stream 158 from the liquefaction compressor system (indicated in general at 162) that is also directed to the heat exchanger 146. The stream 153 exiting the scrub column, while preferably all vapor, contains components that liquefy at a higher temperature (as compared to the vapor stream 156 exiting the top of the column). As a result, the stream 155 entering the column 154 after passing through heat exchanger 146 is two-phase and the liquid component stream performs the reflux. The liquid component stream flows through a reflux liquid component passage that may include, as examples only, a reflux liquid component line that may be external (157) or internal to the scrub device or a downcomer or other internal liquid distribution device within the scrub device 154. As noted above, operation of the liquefaction compressor system may be as described in commonly owned U.S. Pat. No. 9,411,877, to Gushanas et al. After the MR is initially cooled in the heavy hydrocarbon heat exchanger via passage 164, it is flashed across a JT valve 166 to provide a cold mixed refrigerant stream 168 to the heavy hydrocarbon removal heat exchanger.

The temperature of the mixed refrigerant can be controlled by controlling the boiling pressure of the mixed refrigerant.

The components removed from the bottom of the scrub column 154 via stream 172 are returned to the heat exchanger 146 to recover refrigeration and then sent to additional separation steps such as a condensate stripping system, indicated in general at 174 or sent to fuel or other disposal methods.

The feed gas stream 176 exiting the heat exchanger 146, with freezing components removed, is then sent to the main liquefaction heat exchanger 178, or in the case of incorporating an expander/compressor, is first compressed, then sent to the main heat exchanger 178.

An alternative system and method for removing freezing components from a feed gas stream before liquefaction in the main heat exchanger 208 will now be described with reference to FIG. 7. It is to be understood that FIG. 7 shows only one of many possible options for the liquefaction system, indicated in general at 209. The system and method of removing freezing components described below with reference to FIG. 7 can be utilized with any other liquefaction system or method (including, but not limited to, those disclosed in FIGS. 1-6) and integrated within the liquefaction system and method in some cases.

In the system and method of FIG. 7, the feed gas, which flows through line 210, is reduced in pressure with an expander 212, which is connected to a compressor 214 or other loading device such as a brake or generator. The gas is cooled by the expansion process and then further cooled in a heavy hydrocarbon removal heat exchanger 216, then fed to a scrub column or separation drum 218 or other scrub device for the separation of the freezing components from the feed gas.

Optionally, the feed gas may be heated before the expander 212 via a heating device 222 to increase the energy recovered by the expander, and therefore, provide additional compression power. The heating device may be a heat exchanger or any other heating device known in the art.

As in the embodiment of FIG. 6, the refrigeration required to reflux the scrub column via reflux stream 223 is provided by a combination of the return vapor 224 from the column, which is further reduced in pressure and temperature via a JT valve 226 prior to being warmed in the heat exchanger 216, and mixed refrigerant (MR) via line 228 from the liquefaction compressor system, indicated in general at 227. The stream 223 entering the column 218 is two-phase and the liquid component stream performs the reflux. The liquid component stream flows through a reflux liquid component passage that may include, as examples only, a reflux liquid component line that may be external (225) or internal to the scrub device or a downcomer or other internal liquid distribution device within the scrub device 218. As noted above, operation of the liquefaction compressor system may be as described in commonly owned U.S. Pat. No. 9,411,877, to Gushanas et al. After the mixed refrigerant is cooled in the heavy hydrocarbon removal heat exchanger, it is flashed across a JT valve 232 to provide the cold mixed refrigerant to the heavy hydrocarbon removal heat exchanger.

The temperature of the mixed refrigerant can be controlled by controlling the boiling pressure of the mixed refrigerant.

The removed components, after traveling through a freezing components outlet in the scrub column bottom, may be returned to the heat exchanger 216 to recover cold refrigeration via line 234 and then sent to additional separation steps such as a condensate stripping system 238 via line 236 as shown in FIG. 7 or sent to fuel or other disposal methods with or without recovering cold refrigeration.

The feed gas stream, with freezing components removed, 244 is then sent to the main heat exchanger 208 of the liquefaction system, after being compressed in the compressor 214 of the expander/compressor. If additional compression is required, the expander/compressor may be replaced with a compander which can be fitted with the expander, additional compression stages if needed and another driver such as an electric motor 246 or steam turbine, etc. Another option is to simply add a booster compressor in series with the compressor driven by the expander. In all cases, the increased feed gas pressure lowers the energy required for liquefaction and improves liquefaction efficiency, which in turn, can increase liquefaction capacity.

An alternative embodiment of a system and method for removing freezing components from the feed gas stream before liquefaction in the main heat exchanger will now be described with reference to FIG. 8.

Figure 8:
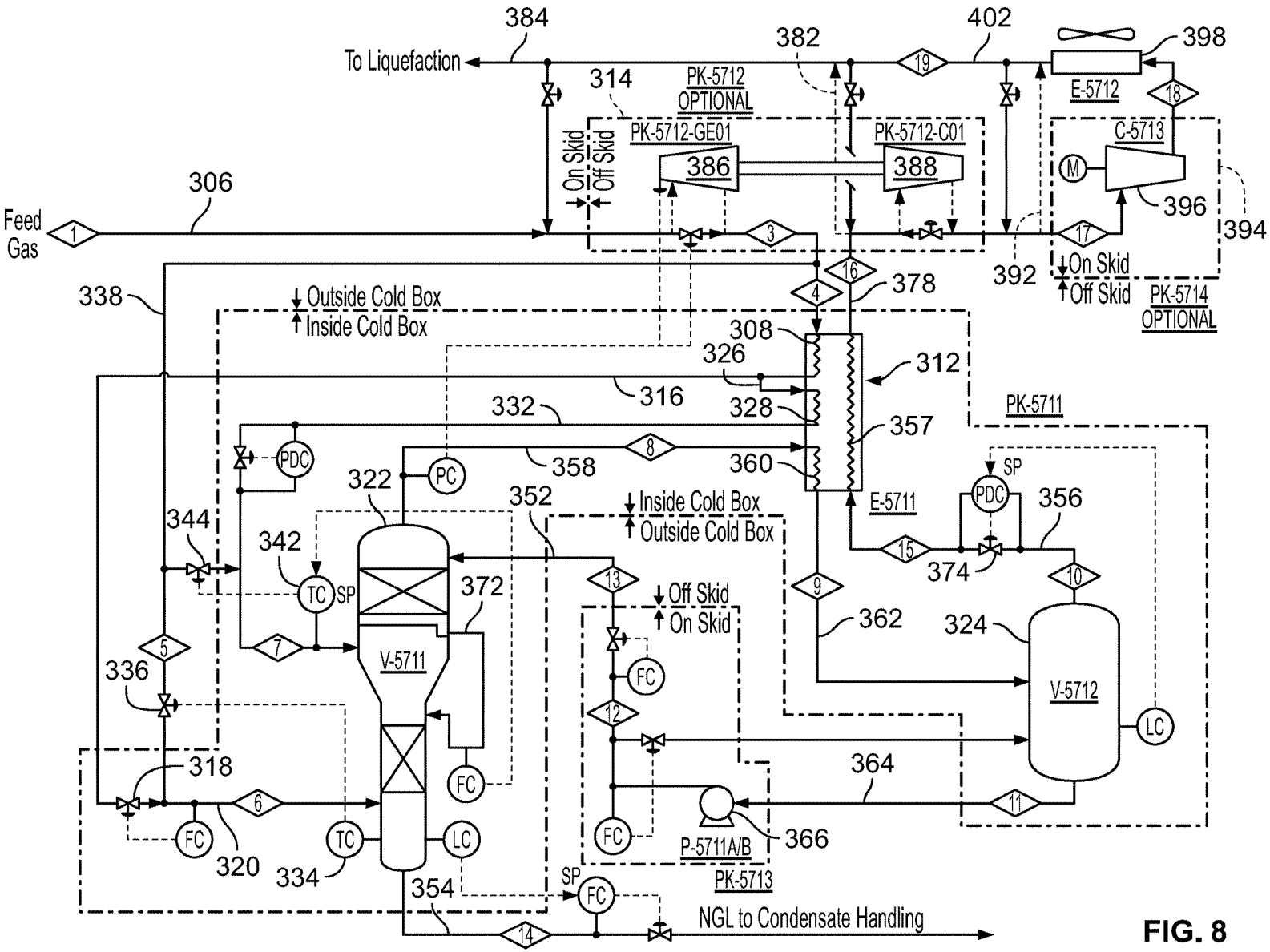
FIG. 8 is a process flow diagram and schematic illustrating a system and method where a feed gas is cooled with a heavy hydrocarbon removal heat exchanger and freezing components are removed from the feed gas.

As shown in FIG. 8, a feed gas stream 306, after any pretreatment systems, is cooled in a passage 308 of a heavy hydrocarbon removal heat exchanger, indicated in general at 312. As explained in greater detail below, an expander and compressor set, indicated in phantom block 314, may optionally be provided so that the feed gas is optionally expanded in the expander before entry into the heavy hydrocarbon removal heat exchanger 312.

The exit stream 316 is then reduced in pressure via a JT valve 318, or other expansion device known in the art, and the scrub column inlet stream 320, which is primarily vapor, is fed to the bottom portion of a scrub column 322, which may be a column, drum or other scrub or stripping device known in the art. A reflux separation device 324, which may be a drum, column or other separation device known in the art, along with the scrub column 322 forms the scrub device of the system.

A stream 326 optionally branches off of stream 316 and be directed to secondary feed cooling passage 328 of the heat exchanger 312 for additional cooling. As a result, a secondary feed stream 332 is formed and delivered to the scrub column 322.

As illustrated in FIG. 8, a temperature sensor 334 is in communication with the bottom portion of the scrub column 322, and controls bypass valve 336 of cooling bypass line 338. Temperature sensor 334 detects the temperature within the bottom portion of the scrub column 322 and compares it with the setting of the associated controller (not shown) for the desired temperature or temperature range. If the temperature detected by sensor 334 is below a preset level, valve 336 opens to direct more fluid through bypass line 338. If the temperature detected by sensor 334 is above a preset level, valve 336 closes (or partially closes) to direct more fluid through the cooling passage 308 of the heat exchanger 312. In an alternative embodiment, the bypass line 338 may instead enter the bottom of the scrub column 322 independently of stream 320.

A temperature sensor 342 monitors and compares the temperature of secondary feed stream 332 with a set point temperature and opens compensation valve 344 to divert some of the flow in bypass line 338 to secondary feed stream 332 to raise the temperature of stream 332 if it is below the set point. Conversely, valve 344 may be closed (or partially closed) if the temperature detected by sensor 342 is above the set point.

Stream 320 enters the bottom of the scrub column 322. The vapor from stream 320 rises within the column and encounters primary and secondary reflux liquid streams 352 and 372 so that the freezing components are condensed. The resulting liquid drops to the bottom of the scrub column 322 and is removed as stream 354. The components removed from the bottom of the scrub column 322 via stream 354 are sent to additional separation steps such as a condensate stripping system, fuel or other disposal methods. The components removed from the bottom of the scrub column as stream 354 may also be returned to the heat exchanger 322 to recover refrigeration, as illustrated for the systems of FIGS. 6 and 7.

Refrigeration required to reflux the column 322 via reflux streams 352 and 372 is provided by the return vapor 356 from the reflux separation device 324, which is warmed in passage 357 of the heat exchanger 312. More specifically, a stream 358 exits the top of the scrub column 322 and is cooled in the heat exchanger 312. While preferably all vapor, stream 358 contains components that liquefy at a higher temperature (as compared to the vapor stream 356 exiting the top of the scrub device 324). As a result, the stream 362 entering the reflux separation device 324, after passing through passage 360 of the heat exchanger 312, is two-phase. Stream 362 is separated into vapor and liquid components within the reflux separation device 324, with the liquid components exiting the device as liquid stream 364. This stream may be pumped via pump 366 and an associated reflux liquid component line, including a reflux liquid component passage, to the top of the scrub column 322 as primary reflux stream 352.

After entering the scrub column 322 the primary reflux stream 352 refluxes vapor in the top portion of the column. A secondary reflux stream, also for refluxing or condensing vapor in the column, may flow through a secondary reflux liquid distribution passage that may include, as examples only, a secondary reflux line 372 that may be external or internal to the scrub device or a downcomer or other internal liquid distribution device within the scrub column 322.

As noted above, the return vapor 356 exiting the top of reflux separation device 324, thus exiting the scrub device of the system, is warmed in passage 357 of the heat exchanger 312 so as to provide refrigeration for passages 308, 328 and 360. As illustrated in FIG. 8, the return vapor 356 from the reflux separation device 324 is further reduced in pressure and temperature via a JT valve 374 prior to being warmed in the heat exchanger 312.

The warm gas stream 378 exiting the heat exchanger 146, with freezing components removed, may then sent to the liquefier via lines 382 (illustrated in phantom) and 384.

As described above, the system of FIG. 8 may optionally include an expander and compressor set, illustrated in phantom block 314, with line 382 omitted. In such an embodiment, the feed gas stream 306 is expanded in an expander 386 before entry into the heavy hydrocarbon removal heat exchanger 312. The expander powers a compressor 388, which receives the gas stream 378 exiting the heat exchanger 312. As a result, the stream 378 is compressed and then sent to the main liquefaction heat exchanger via lines 392 (illustrated in phantom) and 384.

In an alternative embodiment, a second stage of compression of the gas exiting compressor 388 may be provided, as indicated in phantom block 394. Lines 382 and 392 may be omitted in this embodiment. The gas exiting the compressor 388 travels to second stage compressor 396 and is compressed, with the resulting stream being cooled in cooling device 398, which may, as examples only, utilize ambient air cooling or liquid cooling. The resulting stream 402 is sent to the main liquefaction heat exchanger via line 384.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for removing freezing components from a feed gas comprising:

a. a scrub device including:

i) a scrub column having a first feed fluid inlet, a second feed fluid inlet positioned above the first feed fluid inlet, a reflux liquid inlet and a vapor outlet, said first feed fluid inlet configured to receive at least a portion of the feed gas;

ii) a reflux separation device, where the reflux separation device includes a mixed phase inlet, a reflux liquid outlet that is in fluid communication with the reflux liquid inlet of the scrub column, and a reflux separation device vapor outlet;

b. a heat exchanger including a feed gas cooling passage, a secondary feed cooling passage a reflux cooling passage and a return vapor passage, said return vapor passage and said reflux cooling passage of the heat exchanger configured so that fluid flowing through the reflux cooling passage of the heat exchanger is cooled by return fluid flowing through the return vapor passage of the heat exchanger, said feed gas cooling passage having an inlet configured to receive at least a portion of the feed gas, said feed gas cooling passage also including an outlet in fluid communication with the first feed fluid inlet of the scrub column, said heat exchanger configured so that feed gas flowing through the feed gas cooling passage and the secondary feed cooling-passage is cooled by return fluid flowing through the return vapor passage of the heat exchanger to form a cooled feed fluid;

c. a feed expansion device configured to receive and expand cooled feed fluid from the outlet of the feed gas cooling passage of the heat exchanger and to direct a resulting expanded feed fluid to the first feed fluid inlet of the scrub column;

d. said reflux cooling passage of the heat exchanger configured to receive and cool a reflux vapor stream that is at least a portion of the feed gas, prior to any portion of the reflux vapor stream flowing through the return vapor passage of the heat exchanger, so that a mixed phase reflux stream is formed and to direct at least a portion of the mixed phase reflux stream to the mixed phase inlet of the reflux separation device of the scrub device;

e. a return vapor expansion device having an inlet in fluid communication with the reflux separation device vapor outlet, said return vapor expansion device also having an outlet in communication with an inlet of the return vapor passage of the heat exchanger, said return vapor expansion device configured so that a pressure and a temperature of at least a portion of the return vapor stream from the reflux separation device vapor outlet are lowered and directed into the return vapor passage of the heat exchanger;

f. a processed feed gas line in communication with an outlet of the vapor return passage of the heat exchanger;

g. an expander having an inlet configured to receive at least a portion of the feed gas, said expander having an outlet configured to direct feed fluid to the inlet of the feed gas cooling passage of the heat exchanger;

h. a first branch line including an inlet configured to receive a first portion of cooled feed fluid from the outlet of the feed gas cooling passage of the heat exchanger with a remaining second portion of the cooled feed fluid entering the feed expansion device, said first branch line configured to direct the first portion of cooled feed fluid through the secondary feed cooling passage of the heat exchanger so that a further cooled feed fluid is formed;

i. a second branch line configured to direct the further cooled feed fluid to the second feed fluid inlet of the scrub column.

2. The system of claim 1 further comprising:

j. a compressor configured to be powered by the expander, wherein the outlet of the vapor return passage of the heat exchanger is in communication with an inlet of the compressor and an outlet of the compressor is in communication with the processed feed gas line.

3. The system of claim 1 wherein the return vapor expansion device is a Joule-Thomson valve.

4. The system of claim 1 wherein the reflux cooling passage of the heat exchanger is configured to receive a vapor stream from t vapor outlet of the scrub column.

5. The system of claim 1 further comprising:

j. a bypass line having an inlet configured to receive a first portion of a feed gas from the outlet of said expander with a remaining second portion of feed gas entering the feed gas cooling passage of the heat exchanger, said bypass line having an outlet configured to direct fluid from the bypass line into a bottom portion of the scrub column;

k. a first temperature sensor configured to detect a temperature within a bottom portion of the scrub column;

l. a first controller configured to store a first preset temperature;

m. a bypass valve positioned within the bypass line in operative communication with the first temperature sensor and the first controller so that the bypass valve is opened or closed based on a comparison between the temperature detected by the first temperature sensor and the stored first preset temperature;

n. a second temperature sensor configured to detect a temperature of a fluid stream in the second branch line;

o. a compensation valve having an inlet configured to receive fluid from the bypass line and an outlet configured to direct fluid to the second branch line upstream of the second temperature sensor, said compensation valve in operative communication with the second temperature sensor and configured to open or close based on a comparison between a temperature detected by the second temperature sensor and a second preset temperature.

6. The system of claim 5 wherein the bypass line outlet is configured to direct fluid from the bypass line into a junction positioned in a line that extends from an outlet of the feed expansion device into a bottom portion of the scrub column.

* * * * *